US008500246B2

(12) United States Patent
Park et al.

(10) Patent No.: US 8,500,246 B2
(45) Date of Patent: Aug. 6, 2013

(54) INKJET PRINT HEAD AND MANUFACTURING METHOD THEREOF

(75) Inventors: Sung Joon Park, Suwon-si (KR); Jin Wook Lee, Seoul (KR); Chang Shin Park, Seongnam-si (KR); Tae Kyun Kim, Seongnam-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 910 days.

(21) Appl. No.: 12/254,094

(22) Filed: Oct. 20, 2008

(65) Prior Publication Data

US 2009/0237451 A1 Sep. 24, 2009

(30) Foreign Application Priority Data

Mar. 20, 2008 (KR) ..... 10-2008-0025776

(51) Int. Cl.
*B41J 2/135* (2006.01)

(52) U.S. Cl.
USPC ..... 347/44; 347/45; 347/71

(58) Field of Classification Search
USPC ..... 347/40, 45–47, 65, 67, 71
See application file for complete search history.

(56) References Cited

U.S. PATENT DOCUMENTS

| | | | | |
|---|---|---|---|---|
| 4,609,427 | A | 9/1986 | Inamoto et al. | |
| 5,805,186 | A | 9/1998 | Yoshida et al. | |
| 7,930,824 | B2 * | 4/2011 | Ohsumi et al. | 29/890.1 |
| 8,220,905 | B2 * | 7/2012 | Sugahara | 347/70 |
| 2007/0178248 | A1 | 8/2007 | Ohsumi et al. | |

FOREIGN PATENT DOCUMENTS

KR 2005-0112027 11/2005

OTHER PUBLICATIONS

European Search Report issued Jun. 29, 2009 in EP Application No. 08169191.7.

* cited by examiner

*Primary Examiner* — Thinh Nguyen
(74) *Attorney, Agent, or Firm* — Stanzione & Kim, LLP

(57) ABSTRACT

An inkjet print head including a substrate and a first film member stacked on the substrate to form an ink path, and a manufacturing method thereof. The first film member includes a path-defining layer made of a photosensitive material and formed with the ink path, and an adhesive layer made of a photosensitive material and used to stably bond the path-defining layer to the substrate. With this configuration, the path-defining layer and the adhesive layer can be simultaneously stacked on the substrate and also, can be patterned simultaneously.

12 Claims, 8 Drawing Sheets

INKJET PRINT HEAD AND MANUFACTURING METHOD THEREOF

CROSS-REFERENCE TO RELATED APPLICATIONS

This application claims priority under 35 U.S.C. §119(a) from Korean Patent Application No. 2008-0025776, filed on Mar. 20, 2008 in the Korean Intellectual Property Office, the disclosure of which is incorporated herein in its entirety by reference.

BACKGROUND OF THE INVENTION

1. Field of the Invention

The present general inventive concept relates to an inkjet print head and a manufacturing method thereof, and, more particularly, to an inkjet print head including a path-defining layer in which ink paths are defined and a nozzle-defining layer in which nozzles are defined, and a manufacturing method of the inkjet print head.

2. Description of the Related Art

Generally, an inkjet print head is a device to discharge fine droplets of printing ink on a recording medium at desired positions, so as to form an image.

Such an inkjet print head includes a substrate, a surface of which is provided with a discharge-pressure generating element for ink discharge, a path-defining layer which is stacked on the substrate and is defined with ink supply paths, a nozzle-defining layer which is stacked on the path-defining layer and is defined with ink discharge nozzles, and an adhesive layer interposed between the substrate and the path-defining layer to allow the path-defining layer to be stably bonded to the substrate.

Korean Patent Laid-open Publication No. 10-2005-0112027 relates to a manufacturing method of the above-described conventional inkjet print head. The manufacturing method, disclosed in the above Publication, relates to stacking an adhesive layer on a substrate, patterning the adhesive layer via a photolithography process to provide the adhesive layer with a pattern corresponding to a desired pattern to be formed on a path-defining layer, stacking the path-defining layer on the patterned adhesive layer, patterning the path-defining layer via a photolithography process to define ink paths in the path-defining layer, stacking a nozzle-defining layer on the patterned path-defining layer, and patterning the nozzle-defining layer via a photolithography process to define nozzles in the nozzle-defining layer.

In the above-described conventional inkjet print head, however, formation of the adhesive layer is complicated because the adhesive layer must be patterned via a photolithography process to have a pattern corresponding to a desired pattern to be formed at the path-defining layer. Moreover, patterning the adhesive layer and the path-defining layer via individual photolithography processes dramatically complicates coinciding the pattern formed on the adhesive layer with the pattern formed on the path-defining layer.

Further, the conventional inkjet print head includes a water-repellent layer on a surface of the nozzle-defining layer in order to prevent ink from being attached to the surface of the nozzle-defining layer, and patterning the water-repellent layer to have a same pattern as that of the nozzle-defining layer is very complex and practical application thereof is difficult.

SUMMARY OF THE INVENTION

The present general inventive concept provides an inkjet print head and a manufacturing method thereof, wherein an adhesive layer having a same pattern as that of a path-defining layer of the inkjet print head can be more easily formed.

The present general inventive concept also provides an inkjet print head and a manufacturing method thereof, wherein a water-repellent layer can be more easily formed on a nozzle-defining layer of the inkjet print head.

Additional aspects and/or utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an inkjet print head including a substrate, and a first film member stacked on the substrate to define an ink path, wherein the first film member includes a path-defining layer made of a photosensitive material and formed with the ink path, and an adhesive layer made of a photosensitive material and used to stably bond the path-defining layer to the substrate.

The inkjet print head may further include a second film member stacked on the first film member to form a nozzle, and the second film member may include a nozzle-defining layer made of a photosensitive material and formed with the nozzle, and a water-repellent layer made of a photosensitive and water-repellent material.

The foregoing and/or other aspects and utilities of the general inventive concept may also be achieved by providing an inkjet print head including a substrate, a path-defining layer stacked on the substrate to form an ink path, and a second film member stacked on the path-defining layer to form a nozzle, wherein the second film member includes a nozzle-defining layer made of a photosensitive material and formed with the nozzle, and a water-repellent layer made of a photosensitive and water-repellent material.

The path-defining layer may be formed by a first film member stacked on the substrate.

The first film member may include the path-defining layer made of a photosensitive material, and an adhesive layer made of a photosensitive material and used to stably bond the path-defining layer to the substrate.

The foregoing and/or other aspects and utilities of the general inventive concept may also be achieved by providing a manufacturing method of an inkjet print head, the method including preparing a substrate formed with a heating layer to heat ink; forming a first film member including a path-defining layer and an adhesive layer made of photosensitive materials, respectively; and stacking the first film member on the substrate.

The method may further include patterning the path-defining layer and the adhesive layer of the first film member simultaneously via a photolithography process.

The method may further include forming a second film member including a nozzle-defining layer and a water-repellent layer made of photosensitive materials, respectively; and stacking the second film member on the first film member.

The method may further include patterning the nozzle-defining layer and the water-repellent layer of the second film member simultaneously via a photolithography process.

The foregoing and/or other aspects and utilities of the general inventive concept may also be achieved by providing a manufacturing method of an inkjet print head, the method including preparing a substrate formed with a heating layer to heat ink; stacking a path-defining layer, to form an ink path, on the substrate; making a second film member including a nozzle-defining layer and a water-repellent layer made of photosensitive materials, respectively; and stacking the second film member on the path-defining layer.

The method may further include patterning the nozzle-defining layer and the water-repellent layer of the second film member simultaneously via a photolithography process.

The foregoing and/or other aspects and utilities of the general inventive concept may also be achieved by providing an inkjet print head including a substrate, a first film member including a path-defining layer stacked and an adhesive layer disposed on the substrate, and a second film member disposed on the first film member, the second film member including a nozzle-defining layer and a water-repellent layer, wherein the first film member and the second film member are made of one or more photosensitive materials.

The foregoing and/or other aspects and utilities of the general inventive concept may also be achieved by providing a method of manufacturing an inkjet print head, the method including simultaneously stacking a path-defining layer stacked and an adhesive layer; and simultaneously stacking a nozzle-defining layer and a water-repellent layer on the path-defining layer.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
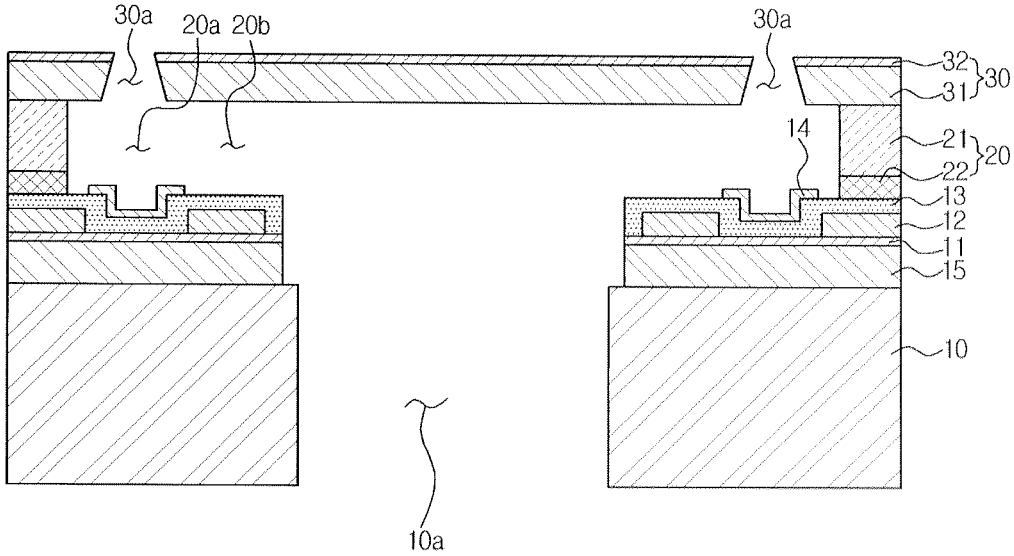
FIG. 1 is a sectional view illustrating an inkjet print head in accordance with an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

An inkjet print head in accordance with an embodiment of the present general inventive concept is a thermally actuated inkjet print head in which ink bubbles are generated using a heat source to discharge ink droplets by expansion of the bubbles. As illustrated in FIG. 1, the inkjet print head includes a substrate 10 serving as a support structure, on which constituent elements of the inkjet print head are arranged. A heating layer 11 as a discharge-pressure generating element for ink discharge is formed on the substrate 10 and in turn, for example, electrodes 12, a passivation layer 13 and an anti-cavitation layer 14 are sequentially formed on the heating layer 11. Also, a heat storage layer 15, which is a silicon oxide insulating layer, is formed between the heating layer 11 and the substrate 10.

A first film member 20 is stacked on the substrate 10, on which the heating layer 11, electrodes 12, passivation layer 13 and anti-cavitation layer 14 are formed. The first film member 20 defines ink paths 20*a* and 20*b*. Further, a second film member 30 is stacked on the first film member 20. The second film member 30 defines nozzles 30*a* for ink discharge. Upon stacking of the first and second film members 20 and 30, manufacture of the inkjet print head is completed.

The substrate 10 is made of a silicon wafer and has an ink feeding hole 10*a*. The heating layer 11 is a thin-film heater made of a high-resistance metal plate formed over the substrate 10 and converts an electric signal, transmitted from the electrodes 12, into thermal energy so as to heat ink. The electrodes 12 are made of a low-resistance metal plate formed over the heating layer 11 and transmit an electric signal applied from common CMOS logic and power transistors, etc. to the heating layer 11.

The passivation layer 13 is made of silicon nitride (SiN), which exhibits good insulation and high heat-transfer efficiency, and is formed to come into contact with the heating layer 11 and the electrodes 12 for protection thereof. The anti-cavitation layer 14 is formed on the passivation layer 13 at positions corresponding to the nozzles 30*a*, and serves to restrict damage to the heating layer 11 due to shrinkage shock caused when ink bubbles generated by thermal energy burst. The heat storage layer 15 prevents heat generated from the heating layer 11 from being transferred to the substrate 10, so as to prevent loss of heat.

The first film member 20 defines the ink paths 20*a* and 20*b* to connect the ink feeding hole 10*a* with the nozzles 30*a*. The ink paths 20*a* and 20*b* include an ink chamber 20*a* which is filled with ink, and a restrictor 20*b* to connect the ink feeding hole 10*a* with the ink chamber 20*a*.

The first film member 20 for use in the inkjet print head in accordance with the present embodiment is made of a photosensitive film, in which a path-defining layer 21 formed with the ink paths 20*a* and 20*b* and an adhesive layer 22 to stably attach the first film member 20 to the substrate 10 are integrally formed with each other, thereby being capable of being simultaneously stacked on the substrate 10. In this case, the path-defining layer 21 and the adhesive layer 22 of the first film member 20 are made of photosensitive materials, respectively, and can be patterned simultaneously via a photolithography process.

The second film member 30 for use in the inkjet print head in accordance with the present embodiment is made of a photosensitive film, in which a nozzle-defining layer 31 formed with the nozzles 30*a* and a water-repellent layer 32 made of a water-repellent material are integrally formed with each other, thereby capable of being simultaneously stacked on the first film member 20. In this case, the nozzle-defining layer 31 and the water-repellent layer 32 of the second film member 30 are made of photosensitive materials, respectively, and can be patterned simultaneously via a photolithography process.

Hereinafter, a manufacturing method of the inkjet print head in accordance with an embodiment of the present general inventive concept will be described with reference to the accompanying drawings.

Figure 2:
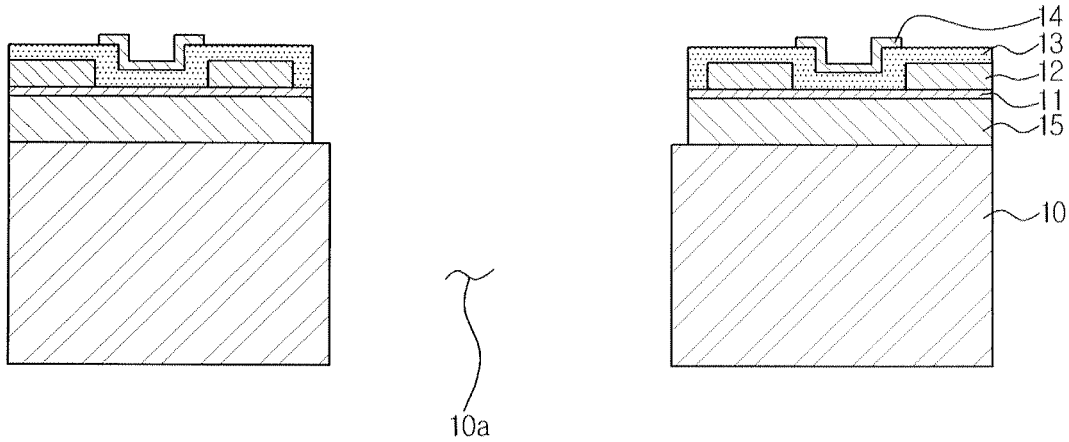
FIG. 2 is a sectional view illustrating a substrate applied in the inkjet print head in accordance with an embodiment of the present general inventive concept.
Figure 3:
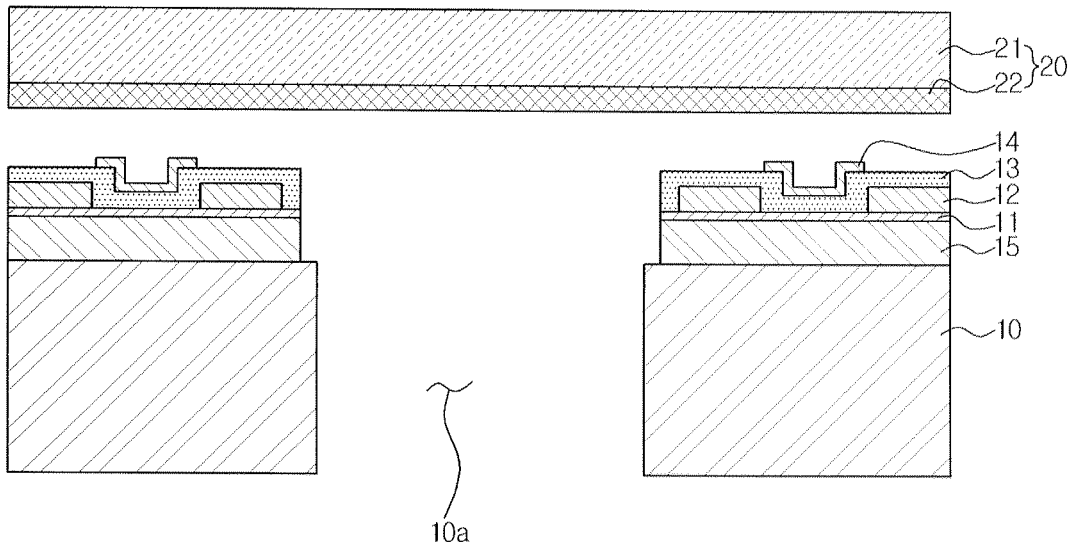
FIG. 3 is a sectional view illustrating an operation to stack a first film member on the substrate of the inkjet print head as illustrated in FIG. 2.
Figure 4:
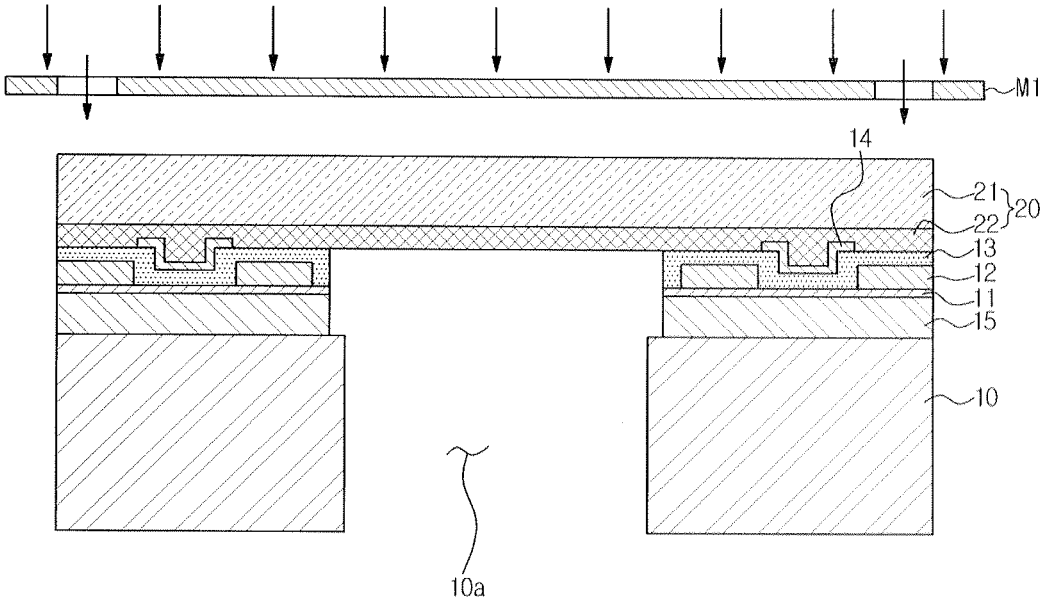
FIGS. 4 and 5 are sectional views illustrating a patterning operation of the first film member as illustrated in FIG. 3 using a photolithography process.
Figure 5:
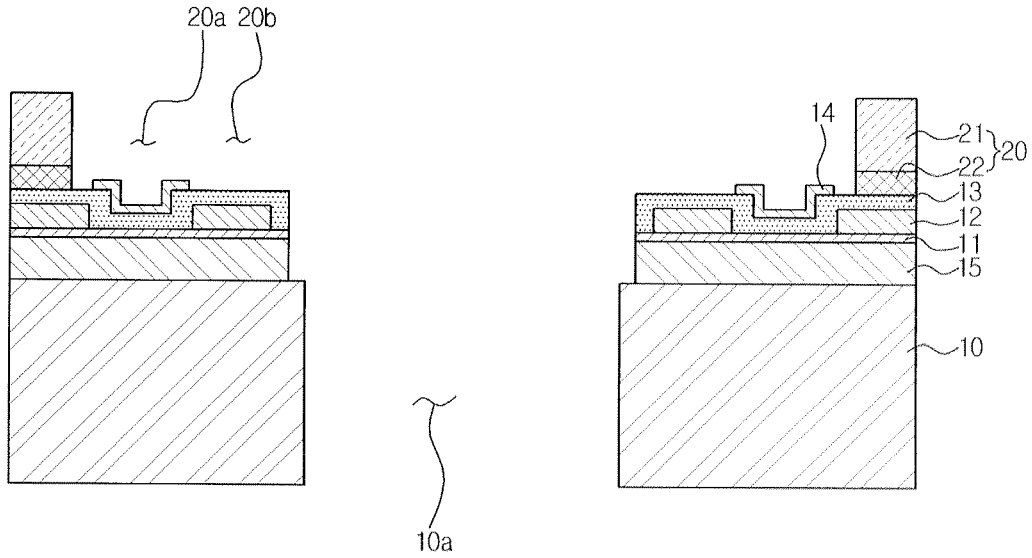
Figure 6:
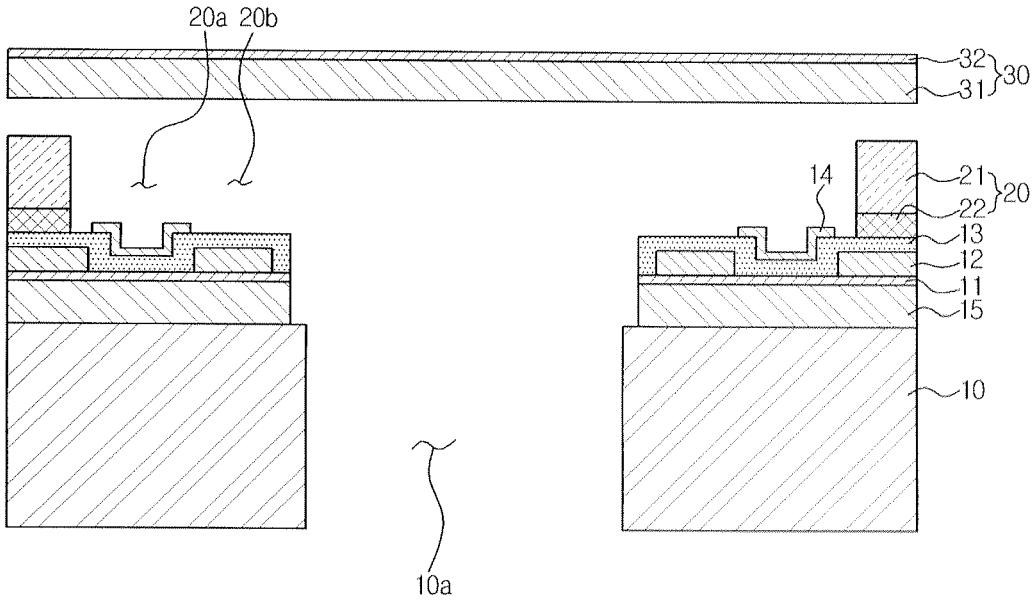
FIG. 6 is a sectional view illustrating an operation to stack a second film member on the first film member as illustrated in FIG. 3.
Figure 7:
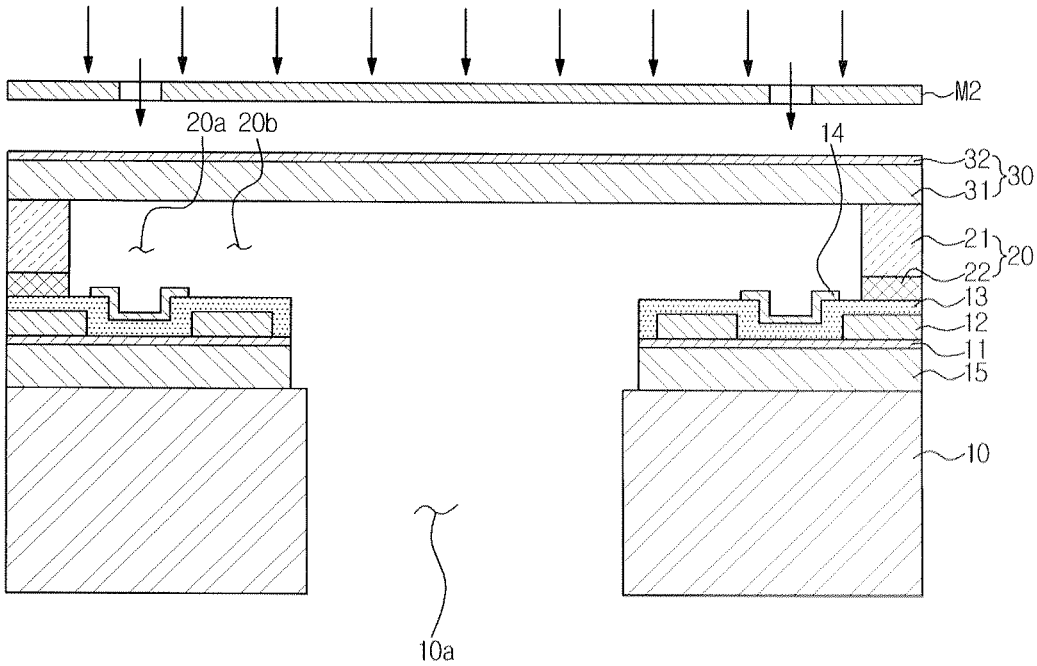
FIG. 7 is a sectional view illustrating a patterning operation of the second film member as illustrated in FIG. 6 using a photolithography process.

The manufacturing method of the inkjet print head in accordance with the present general inventive concept, as illustrated in FIG. 2, includes preparing the substrate 10, on which the heating layer 11, electrodes 12, etc. are formed, as illustrated in FIG. 2; forming the first film member 20 (See FIG. 3) including the path-defining layer 21 and the adhesive layer 22 made of photosensitive materials; forming the second film member 30 (See FIG. 6) consisting of the nozzle-defining layer 31 and the water-repellent layer 32 made of photosensitive materials; stacking the first film member 20 on the substrate 10 as illustrated in FIG. 3; patterning the path-defining layer 21 and the adhesive layer 22 of the first film member 20 simultaneously via a photolithography process using a first photo mask M1, which is formed with a pattern corresponding to a desired pattern to be formed on the first film member 20, as illustrated in FIG. 4, thereby providing the path-defining layer 21 and the adhesive layer 22 with the same pattern as illustrated in FIG. 5; stacking the second film member 30 on the patterned first film member 20 as illustrated in FIG. 6; and patterning the nozzle-defining layer 31 and the water-repellent layer 32 of the second film member 30 simultaneously via a photolithography process using a second photo mask M2, which is formed with a pattern corresponding to the nozzles 30*a* as illustrated in FIG. 7, thereby providing the nozzle-defining layer 31 and the water-repellent layer 32 with the same pattern as illustrated in FIG. 1.

Figure 8:
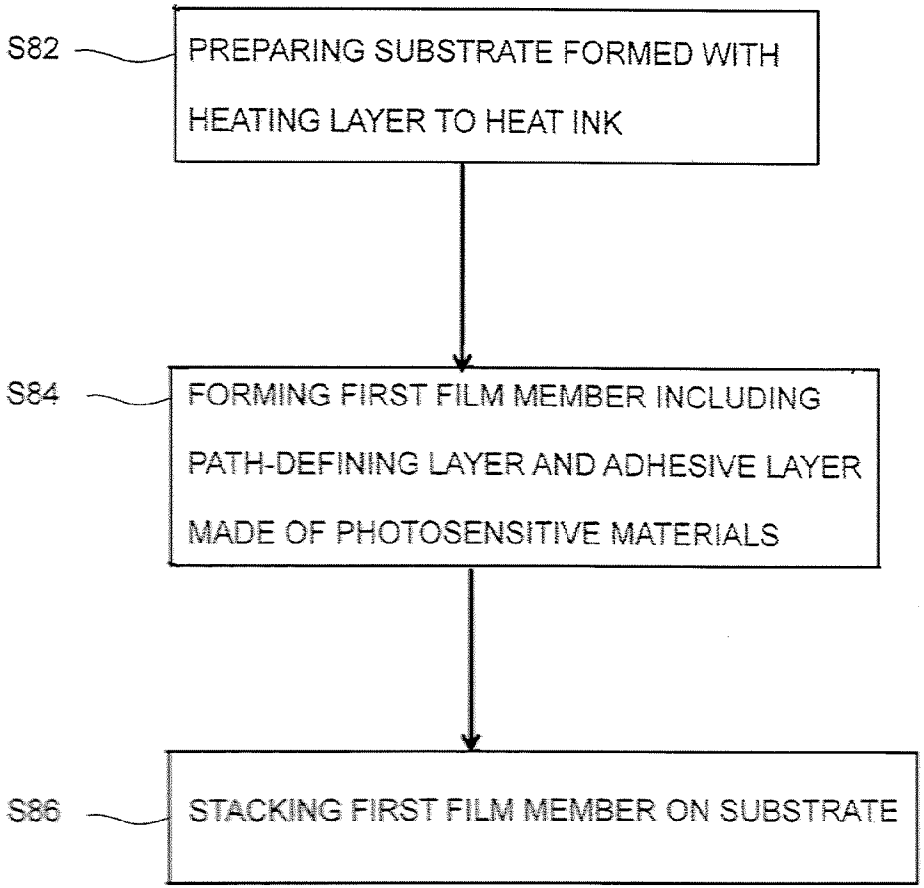
FIG. 8 is a flowchart illustrating a manufacturing method of an inkjet print head according to an embodiment of the present general inventive concept.

FIG. 8 is a flowchart illustrating a manufacturing method of an inkjet print head according to an embodiment of the present general inventive concept. Referring to FIGS. 1 and 8, in operation S82, a substrate 10 formed with a heating layer 11 to heat ink is prepared. In S84, a first film member 20 including a path-defining layer 21 and an adhesive layer 22 made of photosensitive materials is formed. In operation S86, the first film member 20 is stacked on the substrate 10.

As a result of constituting the first film member 20 with the path-defining layer 21 and the adhesive layer 22 made of photosensitive materials, both the path-defining layer 21 and the adhesive layer 22 can be simultaneously stacked on the substrate 10 as the first film member 20 is stacked on the substrate 10 and also, can be patterned simultaneously. Accordingly, both the path-defining layer 21 and the adhesive layer 22 can be formed with the same pattern via a single photolithography process. This can simplify the manufacture of the inkjet print head and also, accurate coinciding a pattern of the path-defining layer 21 with a pattern of the adhesive layer 22 without a delicate pattern alignment process is possible.

In addition, as a result of constituting the second film member 30 with the nozzle-defining layer 31 and the water-repellent layer 32 made of photosensitive materials, both the nozzle-defining layer 31 and the water-repellent layer 32 can be simultaneously stacked on the first film member 20 as the second film member 30 is stacked on the first film member 20 and also, can be patterned simultaneously. Accordingly, both the nozzle-defining layer 31 and the water-repellent layer 32 can be formed with a same pattern via a single photolithography process. This can simplify the manufacture of the inkjet print head, and accurately coinciding the pattern of the nozzle-defining layer 31 with the pattern of the water-repellent layer 32 without a delicate pattern alignment process is possible.

Although the present embodiment proposes that the first film member 20 is first stacked on the substrate 10 to form the adhesive layer 22 and the path-defining layer and thereafter, the second film member 30 is stacked on the first film member 20 to form the nozzle-defining layer 31 and the water-repellent layer 32, the present general inventive concept is not limited thereto. In an alternative embodiment, after the first film member 20 is stacked on the substrate 10 to form the path-defining layer 21 and the adhesive layer 22, the nozzle-defining layer 31 and the water-repellent layer 32 can be formed on the path-defining layer 21 via any one of various methods. In another alternative embodiment, after the path-defining layer 21 is formed on the substrate 10 via any one of various methods, the second film member 30 may be disposed on the path-defining layer 21 to form the nozzle-defining layer 31 and the water-repellent layer 32.

As apparent from the above description, with the inkjet print head in accordance with various embodiments of the present general inventive concept, since the first film member includes the path-defining layer and the adhesive layer made of photosensitive materials, both the path-defining layer and the adhesive layer can be simultaneously stacked on the substrate and also, can be patterned simultaneously. As a result, an embodiment of the present general inventive concept has the effect of simplifying a manufacturing method of the inkjet print head and easily coinciding the pattern of the path-defining layer with the pattern of the adhesive layer.

Further, since the second film member includes the nozzle-defining layer and the water-repellent layer made of photosensitive materials, both the nozzle-defining layer and the water-repellent layer can be simultaneously stacked on the first film member and also, can be patterned simultaneously. As a result, various embodiments of the present general inventive concept has the effect of further simplifying the manufacturing method of the inkjet print head and easily coinciding the pattern of the nozzle-defining layer with the pattern of the water-repellent layer.

Although embodiments of the present general inventive concept have been illustrated and described, it would be appreciated by those skilled in the art that changes may be made in this embodiment without departing from the principles and spirit of the general inventive concept, the scope of which is defined in the claims and their equivalents.

What is claimed is:

1. An inkjet print head, comprising:

a substrate;

a heat storage layer formed on the substrate;

a heating layer formed on the heat storage layer;

an electrode stacked on the heating layer; and a first film member stacked on the electrode to define an ink path, wherein the first film member includes a path-defining layer made of a photosensitive material, and an adhesive layer made of a photosensitive material to bond the path-defining layer to the substrate, the path-defining layer and the adhesive layer being integrally formed to define the ink path such that the path-defining layer and the adhesive layer are simultaneously stacked on the electrode and simultaneously patterned to have a pattern coinciding with each other.

2. The inkjet print head according to claim 1, further comprising:

a second film member stacked on the first film member to form a nozzle, wherein the second film member includes a nozzle-defining layer made of a photosensitive material, and a water-repellent layer made of a photosensitive and water-repellent material, the nozzle-defining layer and the water-repellent layer being integrally formed to form the nozzle such that the water-repellent layer and the nozzle-defining layer have a pattern coinciding with each other.

3. An inkjet print head, comprising:

a substrate;

a heat storage layer formed on the substrate;

a heating layer formed on the heat storage layer;

an electrode stacked on the heating layer;

a path-defining layer stacked on the electrode to form an ink path; and a second film member stacked on the path-defining layer to form a nozzle, wherein the second film member includes a nozzle-defining layer made of a photosensitive material, and a water-repellent layer made of a photosensitive and water-repellent material, the nozzle-defining layer and the water-repellent layer being integrally formed to form the nozzle such that the water-repellent layer and the nozzle-defining layer are simultaneously stacked on the path-defining layer and simultaneously patterned to have a pattern coinciding with each other.

4. The inkjet print head according to claim 3, wherein the path-defining layer is formed by a first film member stacked on the substrate.

5. The inkjet print head according to claim 4, wherein the first film member comprises:

the path-defining layer made of a photosensitive material; and an adhesive layer made of a photosensitive material to bond the path-defining layer to the substrate, wherein the path-defining layer and the adhesive layer are integrally formed to form the ink path such that the path-defining layer and the adhesive layer have a pattern coinciding with each other.

6. A manufacturing method of an inkjet print head, the method comprising:

preparing a substrate formed with a heat storage layer on the substrate and a heating layer on the heat storage layer to heat ink;

stacking an electrode on the heating layer;

forming a first film member including a path-defining layer and an adhesive layer made of photosensitive materials, respectively, the path-defining layer and the adhesive layer being integrally formed with each other such that the path-defining layer and the adhesive layer are simultaneously stacked on the electrode and simultaneously patterned to have a pattern coinciding with each other; and stacking the first film member on the substrate.

7. The method according to claim 6, further comprising:

patterning the path-defining layer and the adhesive layer of the first film member simultaneously via a photolithography process other such that the path-defining layer and the adhesive layer have a pattern coinciding with each other.

8. The method according to claim 6, further comprising:

forming a second film member including a nozzle-defining layer and a water-repellent layer made of photosensitive materials, respectively, the nozzle-defining layer and the water-repellent layer being integrally formed with each other such that the water-repellent layer and the nozzle-defining layer have a pattern coinciding with each other; and stacking the second film member on the first film member.

9. The method according to claim 8, further comprising:

patterning the nozzle-defining layer and the water-repellent layer of the second film member simultaneously via a photolithography process such that the water-repellent layer and the nozzle-defining layer have a pattern coinciding with each other.

10. A manufacturing method of an inkjet print head, the method comprising:

preparing a substrate formed with a heat storage layer on the substrate and a heating layer on the heat storage layer to heat ink;

stacking an electrode on the heating layer;

stacking a path-defining layer, to form an ink path, on the electrode;

making a second film member including a nozzle-defining layer and a water-repellent layer made of photosensitive materials, respectively, the nozzle defining layer and the water-repellent layer being integrally formed with each other such that the water-repellent layer and the nozzle-defining layer are simultaneously stacked on the path-defining layer and simultaneously patterned to have a pattern coinciding with each other; and stacking the second film member on the path-defining layer.

11. The method according to claim 10, further comprising:

patterning the nozzle-defining layer and the water-repellent layer of the second film member simultaneously via a photolithography process such that the water-repellent layer and the nozzle-defining layer have a pattern coinciding with each other.

12. An inkjet print head, comprising:

a substrate;

a heat storage layer formed on the substrate;

a heating layer formed on the heat storage layer;

an electrode stacked on the heating layer;

a first film member including a path-defining layer and an adhesive layer disposed on the electrode, the path-defining layer and the adhesive layer being integrally formed to define an ink path such that the path-defining layer and the adhesive layer are simultaneously stacked on the electrode and simultaneously patterned to have a pattern coinciding with each other; and a second film member disposed on the first film member, the second film member including a nozzle-defining layer and a water-repellent layer, the nozzle-defining layer and the water-repellent layer being integrally formed to form a nozzle such that the water-repellent layer and the nozzle-defining layer are simultaneously stacked on the path-defining layer and simultaneously patterned to have a pattern coinciding with each other, wherein the first film member and the second film member are made of two or more photosensitive materials.

* * * * *